US006889778B2

(12) United States Patent
Colangelo, III et al.

(10) Patent No.: US 6,889,778 B2
(45) Date of Patent: May 10, 2005

(54) ROTARY TOOL

(75) Inventors: Louis J. Colangelo, III, Bethleham, PA (US); Timothy R. Cooper, Titusville, NJ (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 21 days.

(21) Appl. No.: 10/355,698

(22) Filed: Jan. 31, 2003

(65) Prior Publication Data

US 2004/0149469 A1 Aug. 5, 2004

(51) Int. Cl.[7] ..... B25D 15/00

(52) U.S. Cl. ..... 173/93.5; 173/93; 173/93.6; 81/466

(58) Field of Search ..... 173/93, 93.5, 93.6; 81/466, 465

(56) References Cited

U.S. PATENT DOCUMENTS

| | | | | |
|---|---|---|---|---|
| 2,580,631 A | | 1/1952 | Whitledge | |
| 2,802,556 A | * | 8/1957 | Schmid | 173/93.5 |
| 3,072,232 A | | 1/1963 | Martin et al. | |
| 3,321,043 A | | 5/1967 | Vaughn | |
| 3,533,479 A | | 10/1970 | Madsen et al. | |
| 3,552,499 A | | 1/1971 | Maurer | |
| 3,557,884 A | | 1/1971 | Allen | |
| 3,561,543 A | | 2/1971 | Ulbing | |
| 3,661,217 A | * | 5/1972 | Maurer | 173/93.5 |
| 3,703,933 A | | 11/1972 | Schoeps | |
| 4,016,938 A | | 4/1977 | Rice | |
| 4,023,627 A | | 5/1977 | Clapp et al. | |
| 4,026,369 A | | 5/1977 | Vliet | |
| 4,084,646 A | | 4/1978 | Kurt | |
| 4,142,447 A | | 3/1979 | Krasnoff et al. | |
| 4,243,111 A | | 1/1981 | Willoughby et al. | |
| 4,287,956 A | * | 9/1981 | Maurer | 173/93.5 |

(Continued)

*Primary Examiner*—Louis K. Huynh
*Assistant Examiner*—Thanh Truong
(74) *Attorney, Agent, or Firm*—Michael Best & Friedrich LLP

(57) ABSTRACT

A rotary tool, such as an impact wrench, operable in a forward mode and a reverse mode. The rotary tool includes a housing having a forward end and supporting a motor. The motor has a motor shaft extending axially through the housing and defining an axis. The rotary tool also include a frame supported in the housing and being rotatable relative to the housing about the axis, an output shaft supported in the forward end of the housing and rotatable about the axis, and a hammer pivotably coupled to the frame and defining a central aperture. The hammer has a first jaw and a second jaw extending into the central aperture. The first jaw and the second jaw are non-symmetrical.

27 Claims, 11 Drawing Sheets

U.S. PATENT DOCUMENTS 4,321,973 A * 3/1982 Maurer ..... 173/93.5
4,397,220 A 8/1983 Russo et al.
4,440,237 A 4/1984 Casperovich
4,919,022 A 4/1990 Ono et al.
4,977,966 A 12/1990 Farber et al.
5,022,309 A 6/1991 Campbell
5,031,505 A 7/1991 Campbell
RE33,711 E 10/1991 Ono et al.
5,123,504 A 6/1992 Oetting et al.
5,167,309 A 12/1992 Albert et al.
5,172,774 A 12/1992 Melrose
5,197,711 A 3/1993 Geiger et al.
5,213,167 A 5/1993 Best et al.
5,284,318 A 2/1994 Geiger et al.
5,293,747 A 3/1994 Geiger
5,293,959 A 3/1994 Kimberlin
5,305,835 A 4/1994 Campbell et al.
5,346,024 A 9/1994 Geiger et al.
5,350,025 A 9/1994 Campbell et al.
5,377,769 A * 1/1995 Hasuo et al. ..... 173/169
5,400,860 A 3/1995 Best et al.
5,573,073 A 11/1996 Schofield et al.
5,592,396 A 1/1997 Tambini et al.
5,636,698 A 6/1997 Estep et al.
5,680,808 A 10/1997 Day et al.
5,689,434 A 11/1997 Tambini et al.
5,845,718 A 12/1998 Cooper et al.
5,848,655 A 12/1998 Cooper et al.
5,906,244 A * 5/1999 Thompson et al. ..... 173/93.5
6,024,180 A 2/2000 Lin
6,070,674 A 6/2000 Williamson et al.
6,093,128 A 7/2000 Seith
6,135,212 A 10/2000 Georgiou
6,165,096 A 12/2000 Seith
6,491,111 B1 * 12/2002 Livingston et al. ..... 173/93.5
2003/0009262 A1 1/2003 Iangelo, III et al.

* cited by examiner

ROTARY TOOL

FIELD OF THE INVENTION

The present invention relates to rotary tools and, more particularly, to a drive system for a rotary tool.

BACKGROUND OF THE INVENTION

A rotary tool, such as an impact wrench, generally includes a housing supporting a motor, an output shaft having a first end adapted to engage a fastener and a second end having an anvil, and a drive mechanism operable to drive the output shaft. In impact wrenches, the drive mechanism generally includes one or more tilting hammers or dogs, which are rotated about a central axis by the motor and periodically impact the anvil to hammer or drive the output shaft in either a forward or a reverse direction. An operator generally toggles a switch located on the housing to change the rotation direction of the output shaft between the forward and reverse directions. Generally, the operator operates the tool in the forward direction to thread the fastener into engagement with a workpiece, and in a reverse direction to unthread the fastener from the workpiece.

SUMMARY OF THE INVENTION

When an operator tightens a fastener (e.g., a bolt, a screw, a nut, and the like) using a conventional impact wrench, the impact wrench may over-torque or over-tighten the fastener causing the fastener to break. Over-tightened fasteners may be difficult to loosen or remove from a workpiece.

Conventional impact wrenches often include a torque limiting mechanism that limits torque in both the forward and reverse directions. While it may be desirable to limit torque in the forward direction to prevent over-tightening, it is often desirable and/or necessary to have maximum torque in the reverse direction when, for example, the impact wrench is used to remove rusted, corroded, or damaged fasteners.

Conventional impact wrenches often include torque limiting mechanisms that limit the operating speed of the impact wrench. However, operators generally prefer impact wrenches that operate to quickly thread or unthread a fastener.

The present invention provides a rotary tool, such as an impact wrench, which, in one aspect of the invention, is operable in a forward mode and a reverse mode at a plurality of speeds. The plurality of speeds include a maximum speed. The rotary tool includes a housing having a forward end and a rearward end and defining an axis extending between the forward end and the rearward end. The rearward end supports a motor operable in a forward direction and a reverse direction. The rotary tool also includes an output shaft supported in the forward end of the housing and rotatable about the axis, and a hammer supported in the housing and operable to transfer a first rotational force from the motor to the output shaft in the reverse mode and a second rotational force from the motor to the output shaft in the forward mode. The first force is greater than the second force.

In another aspect of the invention, the rotary tool includes a housing having a forward end and supporting a motor. The motor has a motor shaft extending axially through the housing and defining an axis. The rotary tool also includes a frame supported in the housing and being rotatable relative to the housing about the axis, an output shaft supported in the forward end of the housing and rotatable about the axis, and a hammer pivotably coupled to the frame and defining a central aperture. The hammer has a first jaw and a second jaw extending into the central aperture. The first jaw and the second jaw are non-symmetrical.

In yet another aspect of the invention, the rotary tool includes a housing having a forward end and supporting a motor. The motor has a motor shaft extending axially through the housing and defining an axis. The rotary tool also includes a frame supported in the housing and being rotatable relative to the housing about the axis, and a hammer pivotably coupled to the frame and defining a central aperture. The hammer has a first jaw and a second jaw extending into the central aperture. The rotary tool also includes an output shaft supported in the forward end of the housing and being rotatable about the axis. The output shaft has an anvil extending axially through the central aperture. The first jaw lockingly engages the anvil in the reverse mode and the second jaw slidingly engages the anvil in the forward mode.

In still another aspect of the invention, the rotary tool includes a housing having a forward end and supporting a motor. The motor has a motor shaft extending axially through the housing and defining an axis. The rotary tool also includes a frame coupled to the motor shaft and rotatable relative to the housing about the axis in response to rotation of the motor shaft, and a hammer pivotably coupled to the frame and defining a central aperture. The hammer has a first jaw and a second jaw that extend into the central aperture. The first jaw defines a reverse engaging surface and the second jaw defines a forward engaging surface. The rearward engaging surface defines a reverse angle and the forward engaging surface defines a smaller forward angle. The rotary tool further includes an output shaft supported in the forward end of the housing and rotatable about the axis. The output shaft has an anvil extending axially through the central aperture. The forward engaging surface contacts the anvil at the forward angle and the reverse engaging surface contacts the anvil at the reverse angle.

Other features and advantages of the invention will become apparent to those skilled in the art upon review of the following detailed description, claims, and drawings.

BRIEF DESCRIPTION OF THE DRAWINGS

The present invention is further described with reference to the accompanying drawings, which show various embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

As used herein and in the appended claims, the terms "upper", "lower", "first", and "second" are for the purposes of description only and are not intended to imply any particular orientation, order, or importance.

Figure 1:
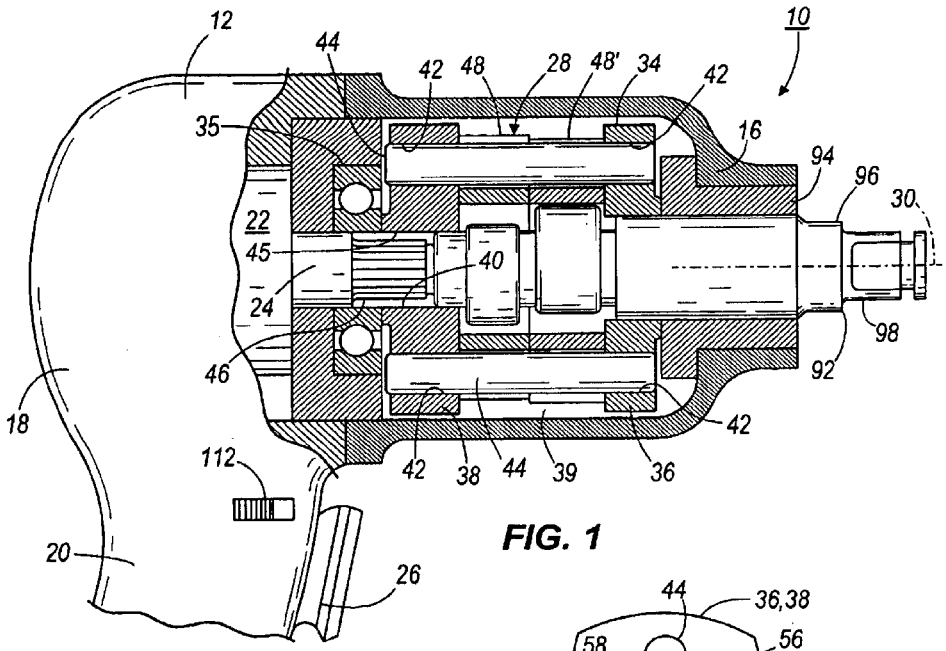
FIG. 1 is a side view, partially in section, of a rotary tool embodying the present invention.

A rotary tool, such as, for example, an impact wrench 10 embodying aspects of the present invention, is illustrated in FIG. 1. The impact wrench 10 includes a housing 12 having a forward end 16 and a rearward end 18, an operator's grip or handle 20, a motor 22 (e.g., an air motor or an electric motor) having a motor shaft 24, a trigger 26 operably coupled to the motor 22 to control motor speed, and a rotary drive system 28. The motor shaft 24 defines an axis 30, which extends axially through the impact wrench 10.

The rotary drive system 28 includes a frame or carrier 34 positioned in the forward end 16 of the housing 12. Bearing 35 supports the frame 34 in the housing 12 and facilitates rotation of the frame 34 about the axis 30 with respect to the housing 12. The frame 34 includes a forward plate 36 and a rearward plate 38, which together define a cavity or interior space 39. The forward and rearward plates 36, 38 are substantially similar and have generally ovular shapes. The plates 36, 38 are formed to include central apertures 40 opening along the axis 30 and through holes 42 positioned above and below the central apertures 40. Fasteners 44 (e.g., pins, rivets, screws, posts, bolts, and the like) extend through holes 42 in the forward and rearward plates 36, 38. As explained in greater detail below, during operation the fasteners 44 experience significant shearing stresses and are therefore preferably made of a relatively durable material (e.g., machine steel, stainless steel, and the like) and preferably have a relatively large cross sectional area. The central aperture 40 of the rearward plate 38 includes splines 45 which, matingly engage corresponding splines 46 on the motor shaft 24 to facilitate the transfer of rotational motion from the motor shaft 24 to the frame 34, as described in greater detail below.

Figure 2:
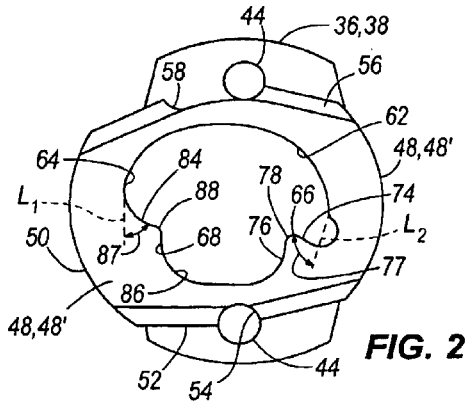
FIG. 2 is a plan view of a portion of a rotary drive system of the rotary tool shown in FIG. 1.

The frame 34 also includes two hammers 48, 48' positioned within the interior space 39 between the forward and rearward plates 36, 38. As shown in FIG. 2, the hammers 48, 48' have generally ovular shapes with arcuate outer surfaces 50. Lower edges 52 of the hammers 48, 48' define U-shaped openings 54 and upper edges 56 define elongated slots 58. The fasteners 44 extend through the U-shaped openings 54 and the elongated slots 58, holding the hammers 48, 48' in position between the forward and rearward plates 36, 38. More particularly, the fasteners 44 pivotably couple the hammers 48, 48' to the forward and rearward plates 36, 38. One fastener 44 holds the upper edges 52 of the hammers 48, 48' fixed with respect to the forward and rearward plates 36, 38, while the elongated slots 58 allow the lower edges 56 of the hammers 48, 48' to pivot arcuately with respect to the forward and rearward plates 36, 38.

The hammers 48, 48' also define central apertures 62, which extend through the hammers 48, 48' and open along the axis 30. Interior surfaces 64 of the hammers 48, 48' define reverse jaws 66 and forward jaws 68 that both extend radially into the central apertures 62. As can be seen in FIG. 2, the interior surfaces 64 are generally smooth surfaces and are arcuately shaped.

Together, the engaging surfaces 74 and the camming surfaces 76 define relatively sharply pointed outer edges 78. As shown in FIG. 2, the engaging surfaces 74 extend sharply from the interior surfaces 64 and are approximately perpendicular to the interior surfaces 64. Conversely, the camming surfaces 76 are arcuately shaped and more gradually intersect the interior surfaces 64. More particularly, the engaging surfaces 74 and lines $L_2$ that extend tangentially from the interior surfaces 64 define reverse angles 77. In the construction illustrated in FIG. 2, the reverse angle 77 is approximately ninety degrees. However, one having ordinary skill in the art will appreciate that in other constructions, the reverse angle 77 can be substantially smaller or larger.

The forward jaws 68 also include engaging surfaces 84 and camming surfaces 86 that intersect to define arcuately shaped outer edges 88. As shown in FIG. 2, both the engaging surfaces 84 and the camming surfaces 86 gradually intersect the interior surfaces 64. More particularly, the engaging surfaces 84 and lines $L_1$ that extend tangentially from the interior surfaces 64 define forward angles 87. In the construction illustrated in FIG. 2, the forward angle 87 is an acute angle. However, one having ordinary skill in the art will appreciate that in other constructions, the forward angle 87 can be substantially smaller or larger.

Figure 3:
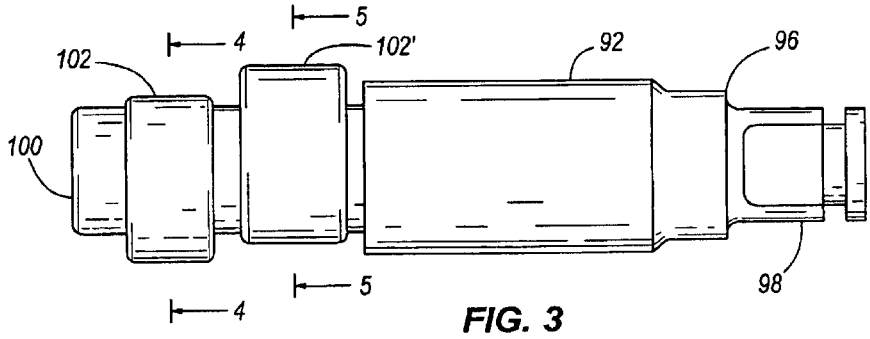
FIG. 3 is a side view of an output shaft of the rotary tool shown in FIG. 1.

The impact wrench 10 also includes an output shaft 92, which is rotatably supported in the forward end 16 by bushing 94 (see FIG. 1) for rotation about the axis 30. The output shaft 92 supports and rotatably engages the forward plate 36. As shown in FIGS. 1 and 3, the output shaft 92 has a first end 96, which includes a tool holder 98 for engaging a fastener (e.g., a bolt, a nut, a screw, and the like), and a second end 100 which includes anvils 102 and 102' (see FIGS. 3–5). The impact wrench 10 illustrated in the figures and described herein includes two anvils 102, 102' for balanced operation. However, it is contemplated that in other embodiments, the present invention can also or alternately include one, three, or more anvils 102. Additionally, in constructions of the present invention having one, three, or more anvils 102, the present invention preferably has a corresponding number of hammers 48, as will be explained below.

Figure 4:
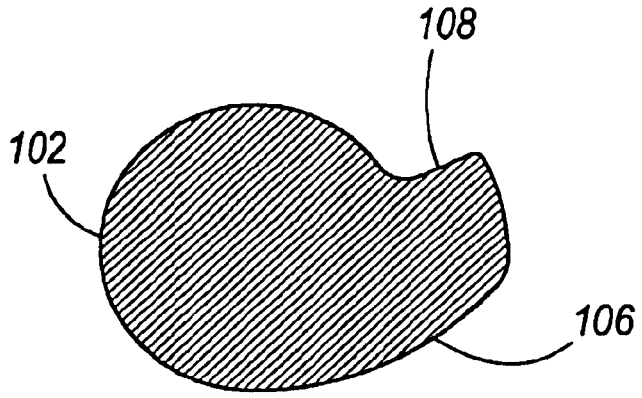
FIGS. 4 and 5 are sectional views through the output shaft of FIG. 2.
Figure 5:
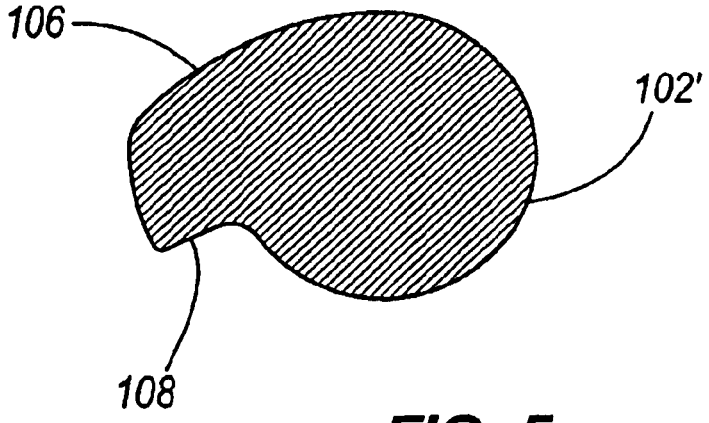

With reference to FIGS. 4 and 5, the anvils 102, 102' each have a leading face 106 and a trailing face 108. In the embodiment illustrated in FIGS. 4 and 5, the leading face 106 is arcuately shaped and is generally swept back toward the trailing face 108. Conversely, the trailing face 108 extends radially from the anvils 102, 102' at an angle of approximately 90 degrees.

During operation, the impact wrench 10 is positioned in close proximity to a fastener (not shown) and the tool holder 98 is positioned to matingly engage the fastener. To tighten the fastener or thread the fastener into a workpiece (not shown), the impact wrench 10 is operated in a forward mode and to loosen the fastener or unthread the fastener from the workpiece, the impact wrench 10 is operated in a reverse mode.

Referring first to operation of the impact wrench 10 in the reverse mode, an operator moves a mode selector 112 (e.g., a toggle switch, a button, a dial, and the like) into a reverse position. The operator then depresses the trigger 26, causing power in the form of compressed air or electricity, to energize the motor 22. Because the user has selected the reverse mode, the motor shaft 24 rotates in a first or reverse direction (represented by arrow 114 in FIGS. 6*a* through 6*l*).

The motor shaft 24 transfers rotational motion to the frame 34 via the mating engagement of splines 45, 46. The hammers 48, 48' rotate with the frame 34 about the axis 30 and intermittently impact the anvils 102, 102', hammering the anvils 102, 102' in the reverse direction 114. This hammering motion is transferred via the anvils 102, 102' and the output shaft 92 to the tool holder 98 (FIG. 1), which removes or unthreads the fastener from the workpiece.

FIGS. 6*a*–6*l* detail the interaction of the hammers 48, 48' and the anvils 102, 102'. For reasons of simplicity and brevity, FIGS. 6*a*–6*l* and the following description refer to the interaction of a single hammer 48 and a single anvil 102. However, it should be understood that the present invention preferably includes two hammers 48, 48' and two anvils 102, 102', which engage each other in substantially the same manner.

Figure 6A:
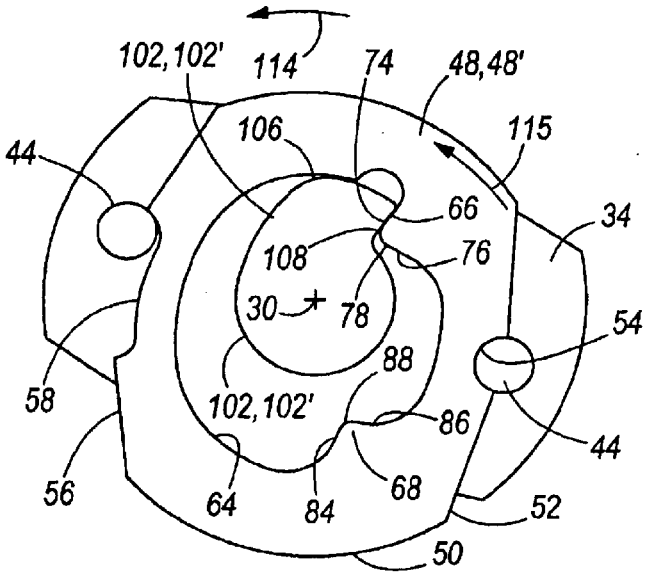
FIGS. 6*a*–6*l* are plan views of the portion of the rotary drive system shown in FIG. 2 operating in a reverse mode.

As shown in FIG. 6*a*, the frame 34 is rotating about the axis 30 in the reverse direction 114. As the frame 34 rotates, the hammer 48 contacts the trailing face 108 of the anvil 102 and applies a reverse force (represented by arrow 115) to the trailing face 108. In the illustrated embodiment, the reverse torque resulting from the reverse force 115 is preferably between about 100 ft-lbs and about 300 ft-lbs. However, in other embodiments the reverse force 115 can be larger or smaller, depending, at least in part, upon one or more of the size and shape of the reverse jaw 66, the contact area between the engaging surface 74 and the trailing surface 108, the radius of the outer edge 78, and the contour of the trailing edge 108. As explained in greater detail below, it is particularly desirable that the reverse torque associated with the reverse force 115 be larger than the forward torque associated with the forward force 117. Therefore, when the impact wrench 10 is operated in the reverse mode, the impact wrench 10 is able to remove or loosen over-tightened fasteners and when the impact wrench 10 is operated in the forward mode, the impact wrench 10 is unable to over-tighten fasteners.

Figure 6B:
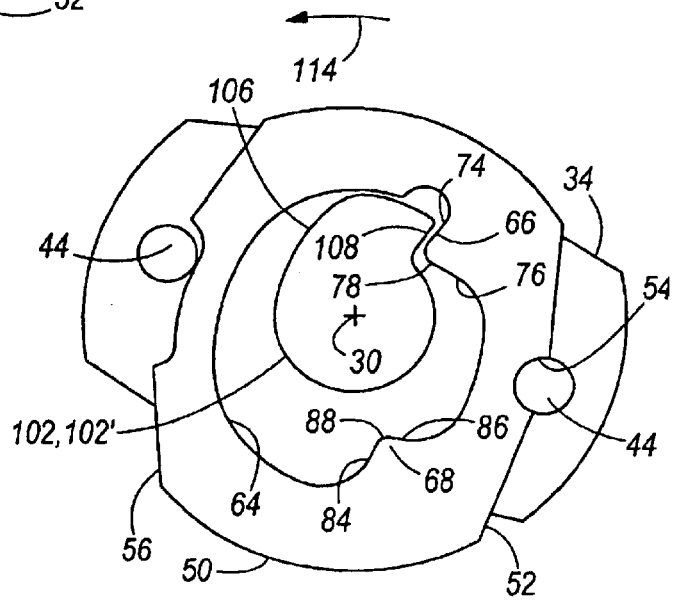
Figure 6C:
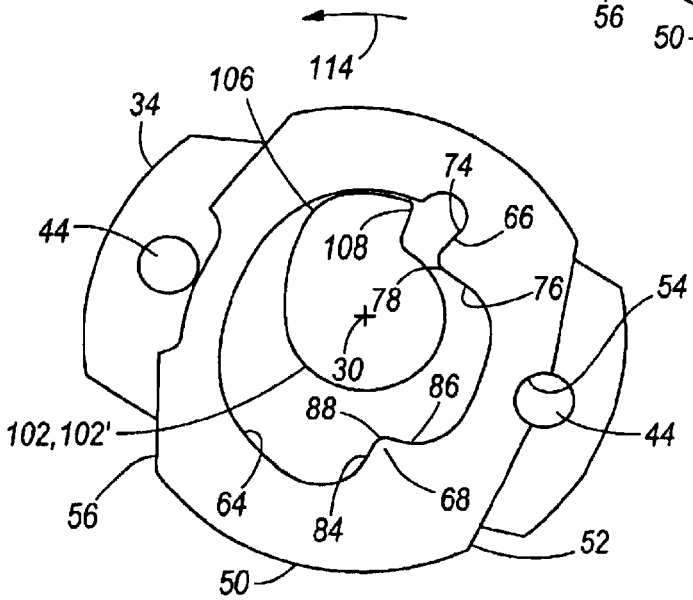
Figure 6D:
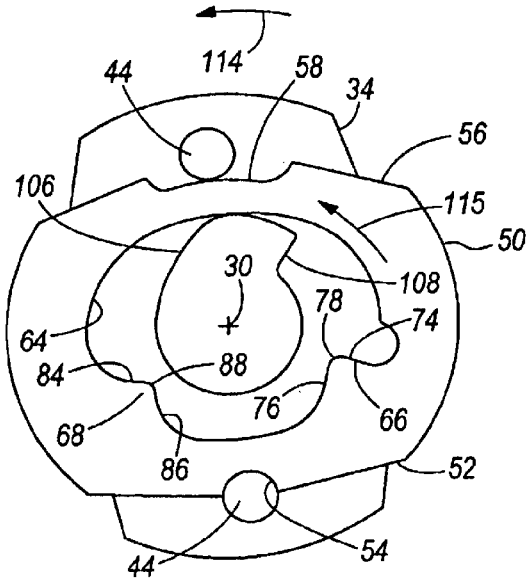
Figure 6E:
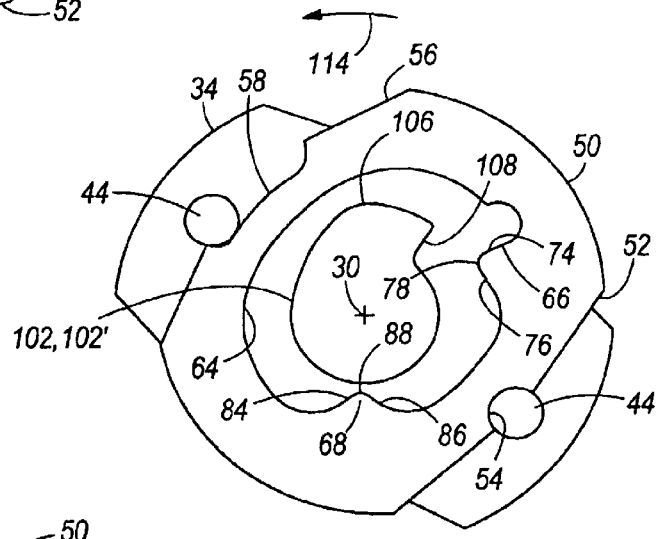
Figure 6F:
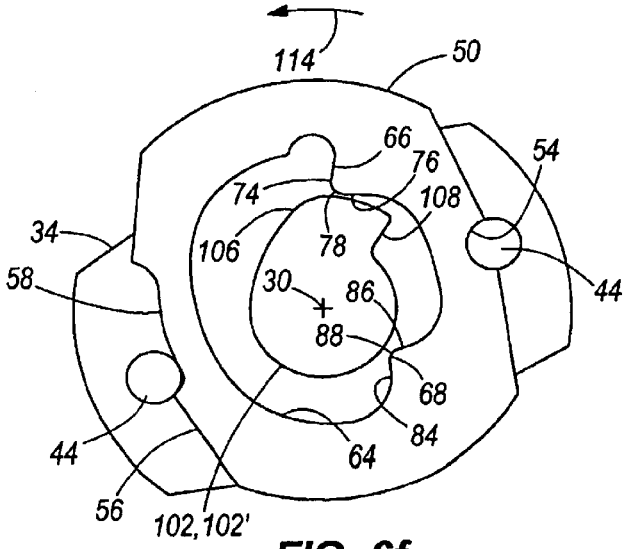
Figure 6G:
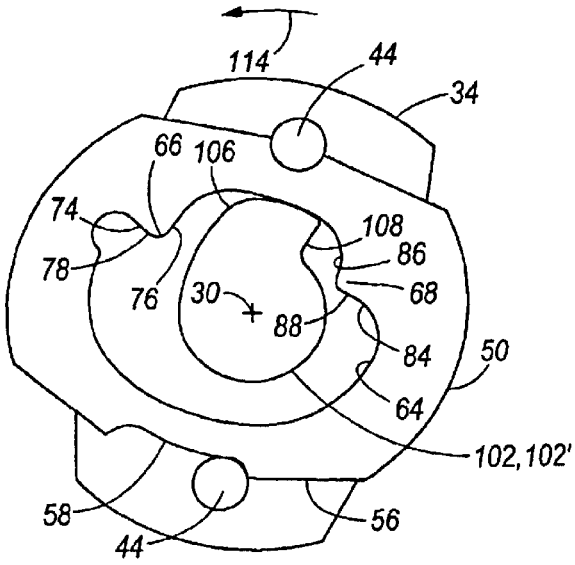
Figure 6H:
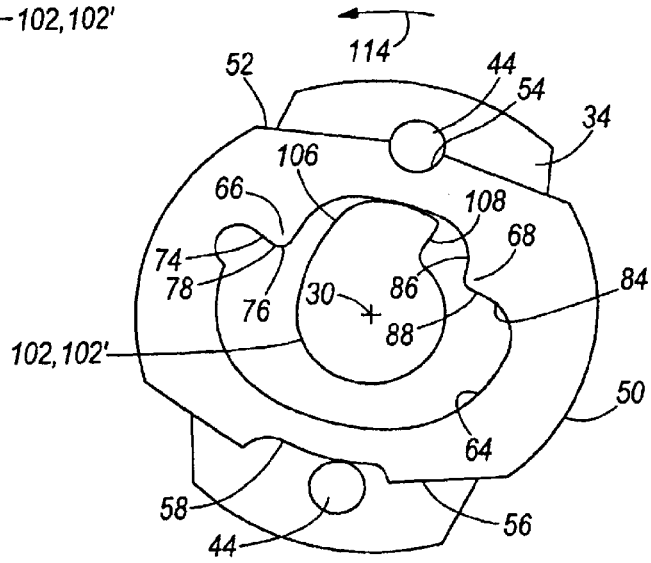
Figure 6I:
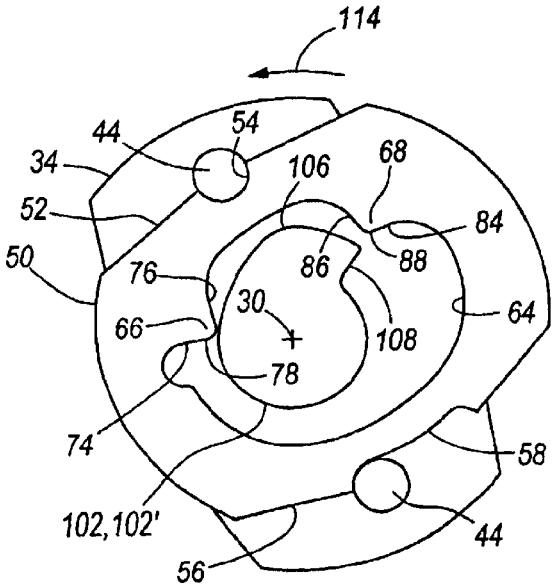
Figure 6J:
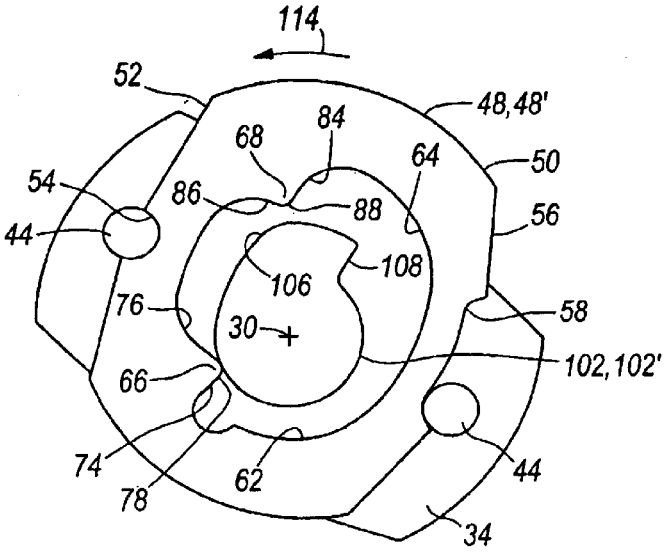
Figure 6K:
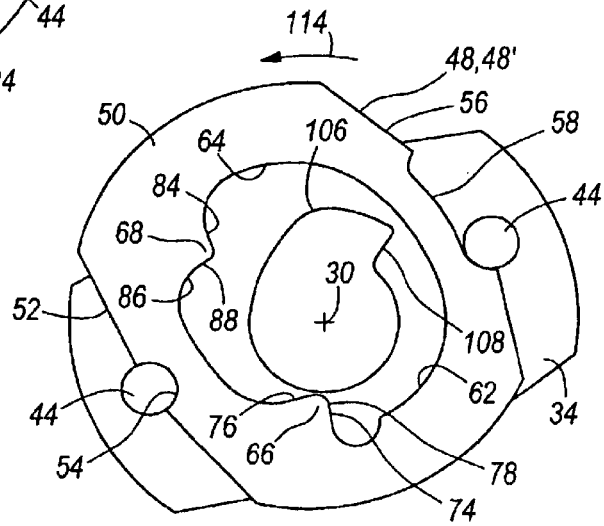
Figure 6L:
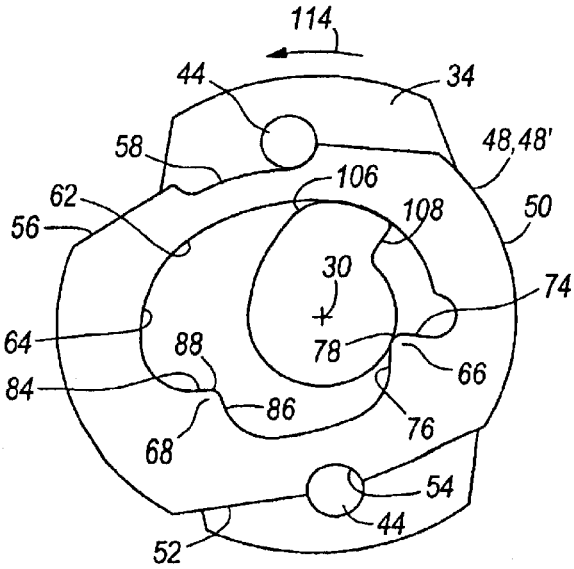

As the hammer 48 rotates about the axis 30, the engaging surface 74 intermittently contacts the trailing edge 108 of the anvil 102. When the engaging surface 74 of the reverse jaw 66 contacts the trailing edge 108 of the anvil 102, the hammer 48 hammers the output shaft 92 in the reverse direction 114, which, in turn, rotates the fastener in a reverse direction. As shown in FIG. 6*b*, the contact between the engaging surface 74 and trailing face 108 causes the hammer 48 to rebound away from the anvil 102 and to tilt about fastener 44 in a direction opposite the reverse direction 114 (see FIGS. 6*c* and 6*d*). As shown in FIG. 6*e*, the hammer 48 continues to rebound until the hammer 48 reaches the point at which the elongated slot 58 engages the fastener 44, preventing the hammer 48 from pivoting any further with respect to the frame 34. The action of the motor 22, the frame 34, and particularly fastener 44, reverses the direction of the hammer 48, causing the hammer 48 to again rotate in the reverse direction 114. Additionally, as shown in FIGS. 6*c*–6*e*, as the hammer 48 rebounds, the hammer 48 tilts or pivots about the fastener 44 with respect to the frame 34. After the hammer 48 pivots, the camming surface 76 and the forward jaw 68 pass across the anvil 102 (see FIGS. 6*f*–6*h* and FIG. 6*i*). After passing the forward jaw 68, the frame 34 and the hammer 48 rotate freely about the axis 30 until the engaging surface 74 of the reverse jaw 66 contacts the trailing face 108 of the anvil 102, initiating a second hammering impact.

Referring now to operation of the impact wrench 10 in the forward mode, the operator moves the mode selector 112 into a forward position. The operator then depresses the trigger 26, causing power in the form of compressed air or electricity to energize the motor 22. Because the user has selected the forward mode, the motor shaft 24 rotates in a second or forward direction (represented by arrow 116 in FIGS. 7*a* through 7*h*).

The motor shaft 24 transfers rotational motion to the frame 34 via the mating engagement of splines 45, 46, as described above with respect to operation in the reverse mode. The hammer 48 rotates with the frame 34 about the axis 30. As the hammer 48 rotates, it intermittently impacts the anvil 102, applying a forward force (represented by arrow 117) to the anvil 102 and hammering the anvil 102 in the forward direction 116. This hammering motion is transferred via the anvil 102 and the output shaft 92 to the tool holder 98, which forces or hammers the fastener into the workpiece.

Figure 7A:
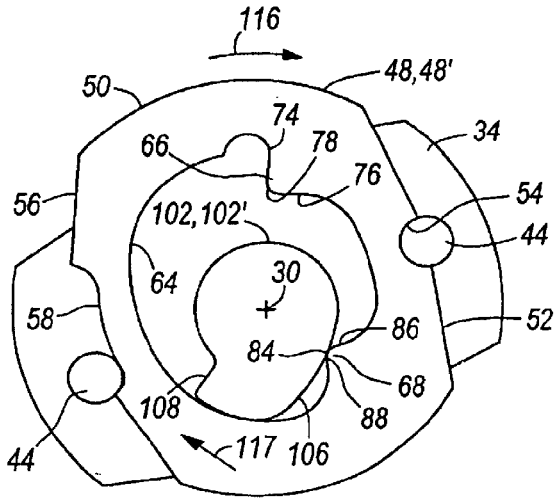
FIGS. 7*a*–7*h* are plan views of the portion of the rotary drive system shown in FIG. 2 operating in a forward mode.
Figure 7B:
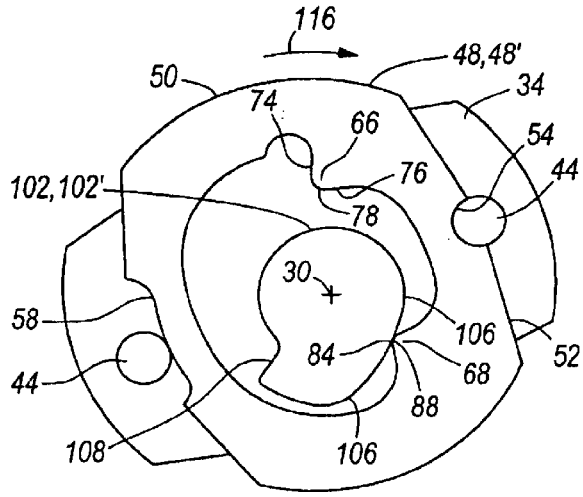
Figure 7C:
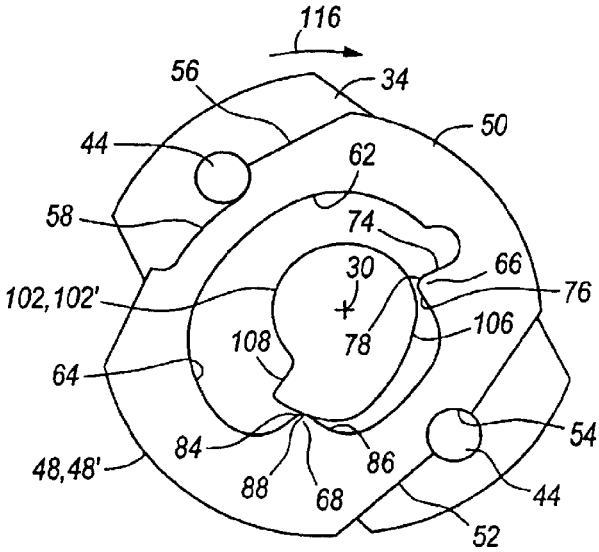
Figure 7D:
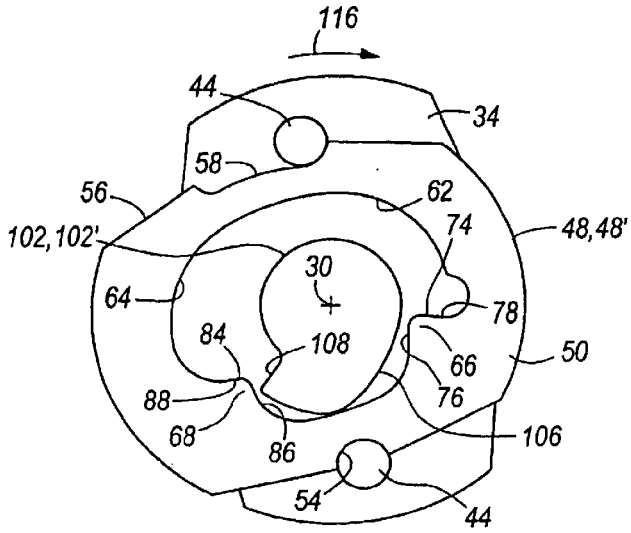
Figure 7E:
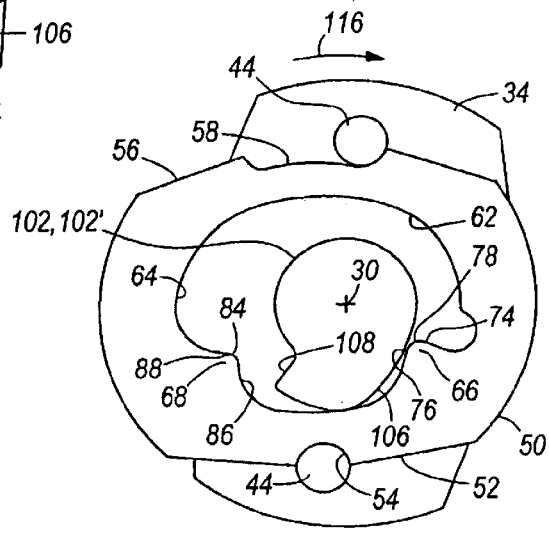
Figure 7F:
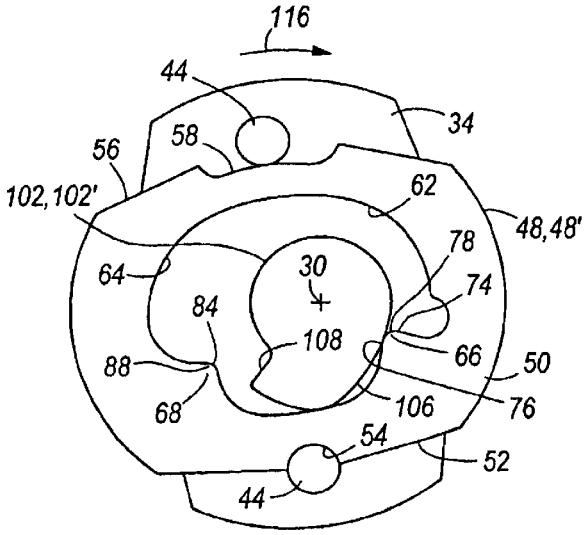
Figure 7G:
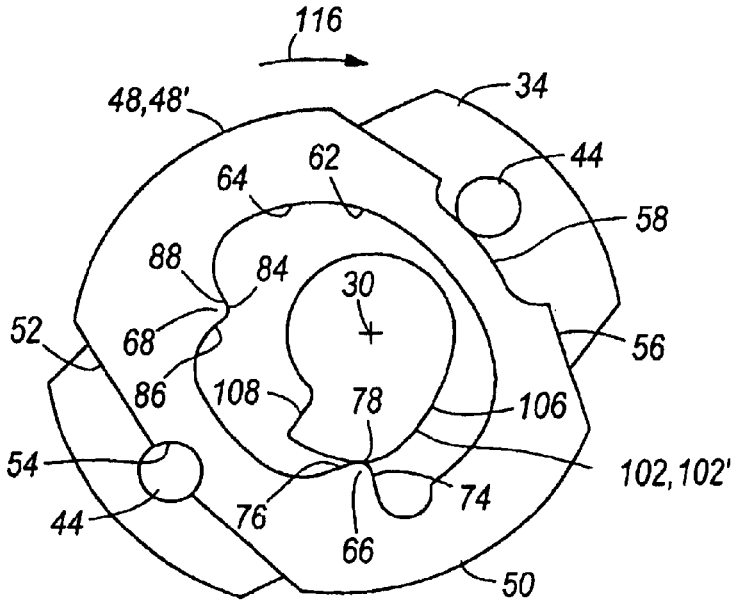
Figure 7H:
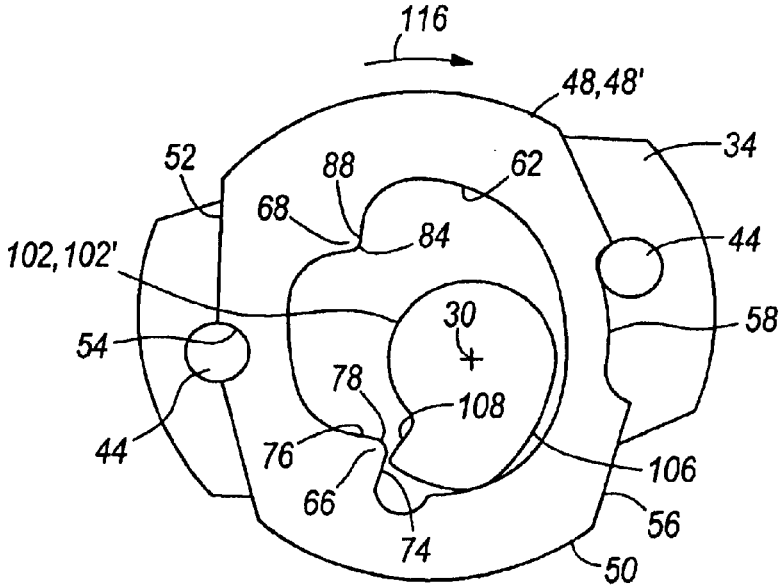

As shown in FIG. 7*a*, the frame 34 is rotating about the axis 30 in the forward direction 116. As the frame 34 rotates, the engaging surface 84 of the forward jaw 68 contacts the leading face 106 of the anvil 102, applying torque resulting from the forward force 117 (e.g., about 50 ft-lbs to about 200 ft-lbs) to the anvil 102. However, because the outer edge 88 of the forward jaw 68 has a relatively large radius, the torque resulting from the forward force 117 is significantly less than the torque resulting from the reverse force 115. More particularly, in the forward mode, the engaging surface 84 does not lockingly engage the leading face 106 of the anvil 102, and as a result, less than all of the rotational energy from the motor 22 and the frame 34 is transferred to the fastener. As shown in FIG. 7*c*, the impact between the forward jaw 68 and the leading face 106 causes the hammer 48 to tilt slightly about fastener 44. The engaging surface 84 then skips or slides across the outer edge 88 of the forward jaw 68. The skipping action allows the hammer 48 to continue to rotate about the axis 30 and to achieve relatively high rotational speeds. More particularly, the skipping action preferably enables the hammer 48 to rotate as fast as or faster in the forward mode than in the reverse mode. The camming surface 86 and the reverse jaw 66 then pass across the anvil 102 (see FIGS. 7*c*–7*e* and FIGS. 7*f*–7*g*). After passing the reverse jaw 66, the frame 34 and the hammer 48 rotate about the axis 30 (see FIG. 7*h*) until the engaging surface 84 of the forward jaw 68 contacts the leading face 106 of the anvil 102 again, initiating a second hammering impact.

FIGS. 8–11 show a second embodiment of the present invention, which is substantial similar to the previously described embodiment. For simplicity, like parts have been labeled with like reference numbers and only differences between the first and second embodiments will be described in detail hereafter.

In the second embodiment of the present invention, a hammer 248 is pivotably coupled to the frame 34 and defines a central aperture 262, which extends through the hammer 248 and opens along the axis 30. An interior surface 264 of the hammer 248 defines a reverse jaw 266 and a forward jaw 268 that both extend radially into the central aperture 262.

Figure 8:
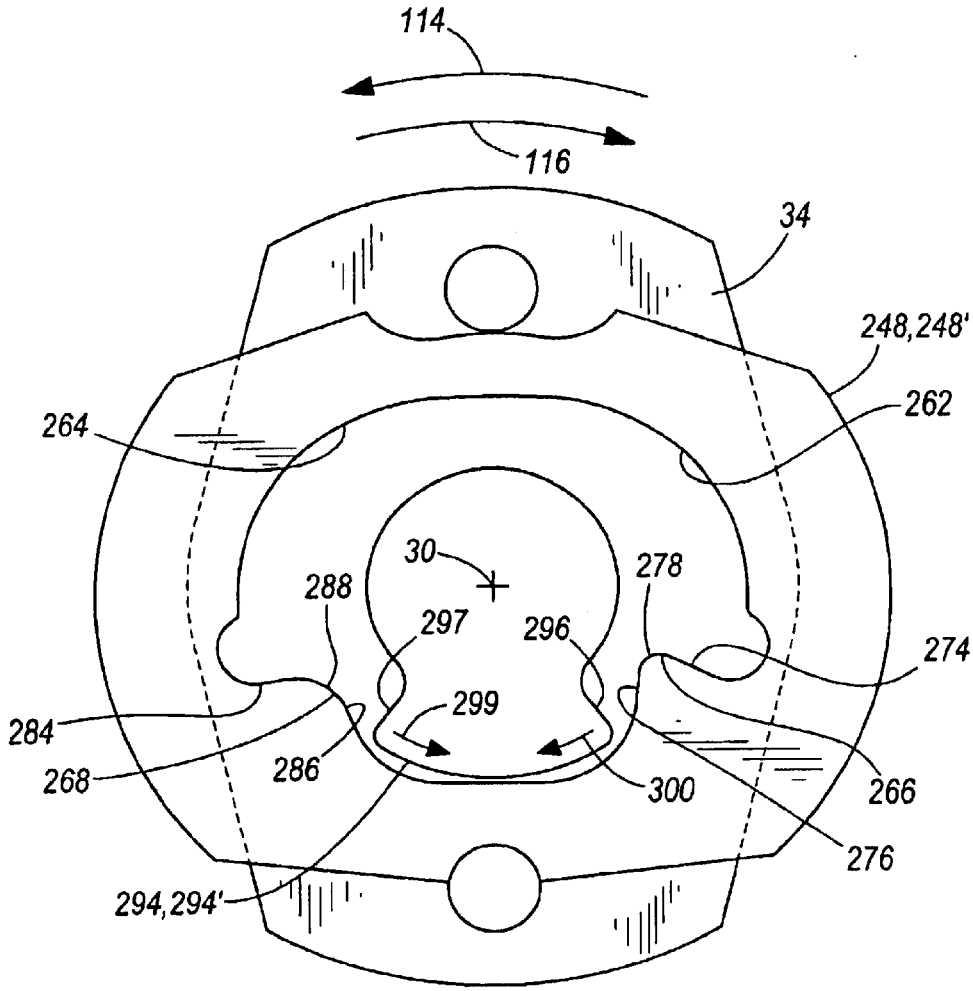
FIG. 8 is a plan view of a portion similar to that shown in FIG. 2 of the rotary drive system according to a second embodiment of the present invention.
Figure 9:
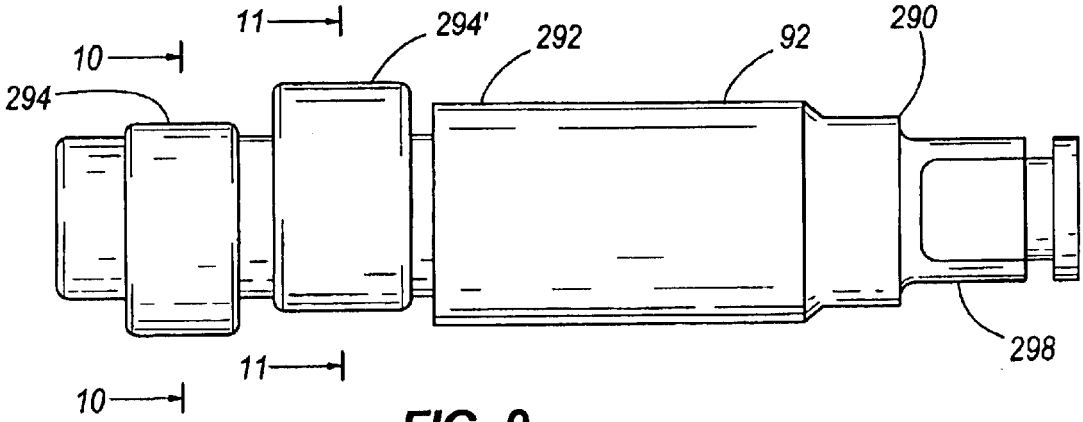
FIG. 9 is a side view of an output shaft of the rotary tool shown in FIG. 8.

The reverse jaw 266 extends into the central aperture 262 and includes an engaging surface 274 and a camming surface 276. Together, the engaging surface 274 and the camming surface 276 define a relatively sharply pointed outer edge 278. As shown in FIG. 8, the engaging surface 274 extends sharply from the interior surface 264 and is approximately perpendicular to the interior surface 264. Conversely, the camming surface 276 is arcuately shaped and gradually intersects the interior surface 264.

The forward jaw 268 extends into the central aperture 262. The forward jaw 268 also includes an engaging surface 284 and a camming surface 286, which intersect to define an arcuately shaped outer edge 288. As shown in FIG. 8, both the engaging surface 284 and the camming surface 286 gradually intersect the interior surface 264.

In the second embodiment, the output shaft 92 (see FIG. 9) has a first end 290, which includes a tool holder 298 for engaging a fastener (e.g., a bolt, a nut, and the like), and a second end 292 which includes anvils 294, 294'. The output shaft 92 illustrated in the figures and described herein includes two anvils 294, 294', which preferably interact with two hammers 248, 248'. However, for simplicity, the following description and the accompanying figures show the interaction of one hammer 248 and one anvil 294.

Figure 10:
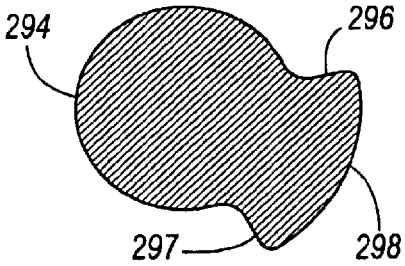
FIGS. 10 and 11 are sectional views through two anvil portions of FIG. 9.
Figure 11:
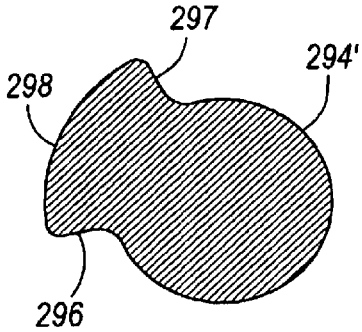

Referring to FIGS. 10 and 11, the anvil 294 has a leading face 296, a trailing face 297, and an arcuately shaped outer surface 298 extending between the leading face 296 and the trailing face 297. The leading face 296 and the trailing face 297 are substantially symmetrical and extend radially from the second end 292 at angles of between about fifty and about eighty degrees.

As shown in FIG. 8, during operation in the reverse mode, the frame 34 rotates about the axis 30 in the reverse direction 114 and the hammer 248 contacts the trailing face 297 of the anvil 294, applying a reverse force (represented by arrow 299) to the trailing face 297. In the illustrated embodiment, the reverse torque associated with the reverse force 299 is preferably between about 100 ft-lbs and about 370 ft-lbs. As the hammer 248 rotates about the axis 30, the engaging surface 274 intermittently contacts the trailing edge 297 of the anvil 294. When the engaging surface 274 of the reverse jaw 266 contacts the trailing edge 297 of the anvil 294, the hammer 248 hammers the output shaft 92 in the reverse direction 114, which, in turn, rotates the fastener in the reverse direction 114. The contact between the engaging surface 274 and trailing face 297 causes the hammer 248 to rebound away from the anvil 297 and to tilt about fastener 44 in a direction opposite the reverse direction 114. When the hammer 248 reaches the point at which the elongated slot 58 engages the fastener 44, the fastener 44 prevents the hammer 248 from pivoting any further with respect to the frame 34. At this point, the frame 34, and particularly the fastener 44, reverses the direction of the hammer 248, causing the hammer 248 to again rotate in the reverse direction 114. After the hammer 248 pivots, the camming surface 276 and the forward jaw 286 can pass across the anvil 294. After passing the forward jaw 268, the frame 34 and the hammer 248 rotate freely about the axis 30 until the engaging surface 274 of the reverse jaw 266 contacts the trailing face 297 of the anvil 294, initiating a second hammering impact.

During operation in the forward mode, the frame 34 rotates about the axis 30 in the forward direction 116 and the engaging surface 284 of the hammer 248 contacts the leading face 296 of the anvil 294, applying a forward force (represented by arrow 300) to the leading face 296. In the illustrated embodiment, the torque associated with the forward force 300 is preferably between about 40 ft-lbs and about 100 ft-lbs. However, because the outer edge 288 of the forward jaw 268 has a relatively large radius, the forward force 300 is significantly less than the reverse force 299.

After applying the forward force 300, the engaging surface 284 skips across the outer edge 298 of the forward jaw 268, causing the hammer 248 to pivot slightly about the fastener 44. This skipping action prevents the hammer 248 from fully impacting the leading edge 296 of the anvil 294. The camming surface 286 and the reverse jaw 266 then pass across the anvil 294. Additionally, because the impact with the leading edge 296 does not force the hammer 248 to rotate in a direction opposite the reverse direction 116, the hammer 248 is able to achieve higher rotational speeds in the forward mode than in the reverse mode. After passing the reverse jaw 266, the frame 34 and the hammer 248 rotate about the axis 30 until the engaging surface 284 of the forward jaw 268 contacts the leading face 296 of the anvil 294 again, initiating a second hammering impact.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

For example, one having ordinary skill in the art will appreciate that the size and relative dimensions of the individual parts of the impact wrench can be changed significantly without departing from the spirit and scope of the present invention.

As such, the functions of the various elements and assemblies of the present invention can be changed to a significant degree without departing from the spirit and scope of the present invention.

What is claimed is:

1. A rotary tool operable in a forward mode and a reverse mode at a plurality of speeds, the plurality of speeds including a maximum speed, the rotary tool comprising:

a housing having a forward end and a rearward end and defining an axis extending between the forward end and the rearward end, the rearward end supporting a motor operable in a forward direction in the forward mode and a reverse direction in the reverse mode;

an output shaft supported in the forward end of the housing and rotatable about the axis; and a hammer supported in the housing and operable to transfer a first rotational force from the motor to the output shaft in the reverse mode and a second rotational force from the motor to the output shaft in the forward mode, the first force being greater than the second force, wherein the hammer defines a central aperture and includes a first jaw extending into the central aperture and a second jaw extending into the central aperture, the first jaw and the second jaw being non-symmetrical.

2. The rotary tool of claim 1, further comprising a frame supported in the housing and being rotatable about the axis and relative to the housing, and wherein the hammer is pivotably coupled to the frame for rotation with the frame about the axis.

3. The rotary tool of claim 1, wherein an interior surface defines the central aperture and, wherein the first jaw gradually intersects the interior surface and wherein the second jaw is substantially perpendicular to at least a portion of the interior surface.

4. The rotary tool of claim 1, wherein a reverse engaging surface of the first jaw engages the output shaft in the reverse mode and a forward engaging surface of the second jaw engages the output shaft in the forward mode.

5. The rotary tool of claim 1, wherein the output shaft has a first end and a second end, the first end including an anvil, the anvil interacting with the hammer to transfer the first rotational force from the motor to the output shaft, and the second end being engageable with a fastener.

6. The rotary tool of claim 5, wherein the anvil includes a leading face and a trailing face, the first jaw impacting the trailing face in the reverse mode, the second jaw impacting the leading face in the forward mode.

7. The rotary tool of claim 6, wherein the first jaw lockingly engages the trailing face in the reverse mode and, the second jaw slidingly engages the leading face in the forward mode.

8. The rotary tool of claim 5, wherein the first jaw has a first leading surface and the second jaw has a second leading surface, and wherein the first jaw engages the first leading surface in the reverse mode and the second jaw engages the second leading surface in the forward mode.

9. The rotary tool of claim 1, wherein the motor is an air motor.

10. The rotary tool of claim 1, wherein the motor is an electric motor.

11. A rotary tool operable in a forward mode and a reverse mode at a plurality of speeds, the plurality of speeds including a maximum speed, the rotary tool comprising:

a housing having a forward end and a rearward end and defining an axis extending between the forward end and the rearward end, the rearward end supporting a motor operable in a forward direction in the forward mode and a reverse direction in the reverse mode;

an output shaft supported in the forward end of the housing and rotatable about the axis and having a first end and a second end, the first end including an anvil having a substantially arcuate leading face and an angled trailing face and the second end being engageable with a fastener;

a hammer supported in the housing and operable to transfer a first rotational force from the motor to the output shaft in the reverse mode and a second rotational force from the motor to the output shaft in the forward mode, the first force being greater than the second force, wherein the anvil interacts with the hammer to transfer the first rotational force from the motor to the output shaft.

12. A rotary tool operable in a forward mode and a reverse mode, the rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft;

an output shaft supported in the forward end of the housing and rotatable about the axis; and a hammer pivotably coupled to the frame and defining a central aperture, the hammer having a first jaw and a second jaw extending into the central aperture, the first jaw and the second jaw being non-symmetrical, the first jaw and the second jaw transferring rotational motion of the hammer to the output shaft.

13. The rotary tool of claim 1, wherein the output shaft includes an anvil, and wherein the first jaw engages the anvil in the reverse mode and the second jaw engages the anvil in the forward mode.

14. The rotary tool of claim 13, wherein the anvil has a substantially arcuate leading face and an angled trailing face.

15. The rotary tool of claim 13, wherein the anvil includes a leading face and a trailing face, the first jaw impacting the trailing face in the reverse mode, the second jaw impacting the leading face in the forward mode.

16. The rotary tool of claim 12, wherein the anvil has a substantially arcuate leading face and an angled trailing face, the first jaw impacting the leading face in the reverse mode, the second jaw slidably impacting the trailing face in the forward mode.

17. The rotary tool of claim 16, wherein the first jaw has a first trailing surface and the second jaw has a second leading surface, and wherein the first jaw engages the first trailing surface in the reverse mode and the second jaw engages the second leading surface in the reverse mode.

18. The rotary tool of claim 12, wherein the motor is an air motor.

19. The rotary tool of claim 12, wherein the motor is an electric motor.

20. The rotary tool of claim 12, wherein the hammer is operable to transfer a first rotational force from the motor to the output shaft in the reverse mode and a second rotational force from the motor to the output shaft in the forward mode, the first force being greater than the second force.

21. A rotary tool operable in a forward mode and a reverse mode, the rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft;

a hammer pivotably coupled to the frame and defining a central aperture, the hammer having a first jaw and a second jaw extending into the central aperture; and an output shaft supported in the forward end of the housing and being rotatable about the axis, the output shaft having an anvil extending axially through the central aperture, the first jaw lockingly engaging the anvil in the reverse mode and the second jaw slidingly engaging the anvil in the forward mode, the first jaw and the second jaw transferring rotational motion of the hammer to the output shaft wherein the hammer is operable to transfer a first rotational force from the motor to the output shaft in the reverse mode and a second rotational force from the motor to the output shaft in the forward mode, the first force being greater than the second force.

22. A rotary tool operable in a forward mode and a reverse mode the rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft;

a hammer pivotably coupled to the frame and defining a central aperture, the hammer having a first jaw and a second jaw extending into the central aperture; and an output shaft supported in the forward end of the housing and being rotatable about the axis, the output shaft having an anvil extending axially through the central aperture, the first jaw lockingly engaging the anvil in the reverse mode and the second jaw slidingly engaging the anvil in the forward mode, the first jaw and the second jaw being non-symmetrical and transferring rotational motion of the hammer to the output shaft.

23. A rotary tool operable in a forward mode and a reverse mode, the rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft;

a hammer pivotably coupled to the frame and defining a central aperture, the hammer having a first jaw and a second jaw extending into the central aperture; and an output shaft supported in the forward end of the housing and being rotatable about the axis, the output shaft having an anvil having a substantially arcuate leading face and an angled trailing face and extending axially through the central aperture, the first jaw lockingly engaging the anvil in the reverse mode and the second jaw slidingly engaging the anvil in the forward mode, the first jaw and the second jaw transferring rotational motion of the hammer to the output shaft.

24. A rotary tool operable in a forward mode and a reverse mode, the rotary tool comprising:

a housing having a forward end and supporting a motor, the motor having a motor shaft extending axially through the housing and defining an axis about which the motor shaft rotates in one of a forward direction and a reverse direction;

a frame coupled to the motor shaft and being rotatable relative to the housing about the axis in response to rotation of the motor shaft;

a hammer pivotably coupled to the frame and defining a central aperture, the hammer having a first jaw and a second jaw extending into the central aperture, the first jaw having a reverse engaging surface, the second jaw having a forward engaging surface, the reverse engaging surface defining a reverse angle, the forward engaging surface defining a forward angle, the reverse angle being greater than the forward angle; and an output shaft supported in the forward end of the housing and being rotatable about the axis, the output shaft having an anvil extending axially through the central aperture, the forward engaging surface contacting the anvil when the motor shaft is rotated in the forward direction and the reverse engaging surface contacting the anvil when the motor shaft is rotated in the reverse direction.

25. The rotary tool of claim 24, wherein the hammer is operable to transfer a first rotational force from the motor to the output shaft when the motor shaft is rotated in the reverse direction and a second rotational force from the motor to the output shaft when the motor shaft is rotated in the forward direction, the first force being greater than the second force.

26. The rotary tool of claim 24, wherein the first jaw lockingly engages the trailing face when the motor shaft is rotated in the reverse direction and, the second jaw slidingly engages the leading face when the motor shaft is rotated in the forward direction.

27. The rotary tool of claim 24, wherein the first and second jaws are non-symmetrical.

* * * * *